US006622554B2

(12) United States Patent
Manke et al.

(10) Patent No.: US 6,622,554 B2
(45) Date of Patent: Sep. 23, 2003

(54) OPEN HOLE FORMATION TESTING

(75) Inventors: Kevin R. Manke, Marlow, OK (US); Harold Wayne Nivens, Runaway Bay, TX (US); Samuel Bianco, Stavanger (NO); Charles M. MacPhail, Gladewater, TX (US); Ricardo Maldonado, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 78 days.

(21) Appl. No.: 09/873,814

(22) Filed: Jun. 4, 2001

(65) Prior Publication Data

US 2002/0178804 A1 Dec. 5, 2002

(51) Int. Cl.[7] ..... E21B 49/00; E21B 49/08; E21B 47/10

(52) U.S. Cl. ..... 73/152.55; 73/152.39; 166/264

(58) Field of Search ..... 73/152.55, 152.18, 73/152.39, 152.38, 152.27, 152.24; 166/264, 250.01

(56) References Cited

U.S. PATENT DOCUMENTS

| | | | | | |
|---|---|---|---|---|---|
| 2,013,995 | A | * | 9/1935 | Straatman | 177/311 |
| 2,702,474 | A | * | 2/1955 | Johnston | 73/152.55 |
| 3,412,607 | A | * | 11/1968 | Jensen | 73/152.55 |
| 3,611,799 | A | * | 10/1971 | Davis | 73/152.55 |
| 3,743,014 | A | | 7/1973 | Jessup | 166/69 |
| 3,762,219 | A | | 10/1973 | Jessup | 73/155 |
| 3,981,188 | A | * | 9/1976 | Barrington et al. | 73/152.55 |
| 4,046,006 | A | * | 9/1977 | Dufrene | 73/152.55 |
| 4,392,377 | A | * | 7/1983 | Ramkin | 73/152.38 |
| 4,458,245 | A | * | 7/1984 | Crosnier et al. | 340/853 |
| 4,635,717 | A | * | 1/1987 | Jageler | 166/250 |
| 4,878,538 | A | | 11/1989 | Christensen | 166/264 |
| 5,065,619 | A | * | 11/1991 | Myska | 73/152.39 |
| 5,097,902 | A | | 3/1992 | Clark | 166/187 |
| 5,332,035 | A | | 7/1994 | Schultz et al. | 166/53 |
| 5,353,637 | A | * | 10/1994 | Plumb et al. | 73/152.39 |
| 5,791,414 | A | | 8/1998 | Skinner et al. | 166/187 |
| 5,808,192 | A | * | 9/1998 | Schmidt | 73/152.55 |
| 5,826,662 | A | | 10/1998 | Beck et al. | 166/387 |
| 5,887,652 | A | | 3/1999 | Beck et al. | 166/264 |
| 6,058,772 | A | * | 5/2000 | Aalto | 73/152.24 |
| 6,062,073 | A | * | 5/2000 | Patton et al. | 73/152.28 |
| 6,325,146 | B1 | | 12/2001 | Ringgenberg et al. | 166/250.17 |
| 6,328,103 | B1 | | 12/2001 | Pahmiyer et al. | 166/250.17 |

FOREIGN PATENT DOCUMENTS

| | | |
|---|---|---|
| EP | 0 295 922 A2 | 6/1988 |
| EP | 0 896 126 A2 | 8/1998 |
| WO | WO 00/58604 | 10/2000 |

OTHER PUBLICATIONS

European Search Report Application No.: EP 02 253,566 (as a PCT case).

* cited by examiner

*Primary Examiner*—Hezron Williams
*Assistant Examiner*—David J. Wiggins
(74) *Attorney, Agent, or Firm*—Marlin R. Smith; J. Richard Konneker

(57) ABSTRACT

Systems and methods particularly suitable for open hole formation testing are provided. In a described embodiment, a method of performing a test on a formation intersected by a wellbore includes the steps of flowing fluid into an apparatus from the formation, displacing a fluid barrier of the apparatus in one direction, flowing the formation fluid out of the apparatus and back into the formation by applying pressure to the apparatus, and displacing the fluid barrier in an opposite direction.

27 Claims, 3 Drawing Sheets

OPEN HOLE FORMATION TESTING

BACKGROUND

The present invention relates generally to formation testing in subterranean wells and, in an embodiment described herein, more particularly provides a method and system for open hole formation testing.

Open hole formation testing is well known in the art. Typically, compression-set or inflatable packers are used to straddle a formation intersected by an uncased wellbore, and formation fluid is drawn from the formation into a test string extending to the earth's surface. Generally, the formation fluid is flowed to the surface, where it may be sampled, tested, etc.

Because of safety and environmental concerns with flowing the formation fluid to the surface, it would be advantageous to be able to perform formation testing without flowing the formation fluid to the surface. The formation fluid should be flowed only into the test string, and then flowed back (i.e., re-injected) into the formation from which it originated, or into another disposal formation.

Unfortunately, satisfactory methods and systems for accomplishing such a formation test in an open hole environment have not yet been developed. Therefore, it would be highly advantageous to provide systems and methods whereby a formation test may be performed in an uncased wellbore, and without flowing formation fluid to the surface.

SUMMARY

In carrying out the principles of the present invention, in accordance with an embodiment thereof, systems and methods for open hole testing are provided. The systems and methods utilize a fluid barrier reciprocably received within an apparatus and displaceable when fluid is flowed between the apparatus and a formation. Other systems and methods are provided, as well.

In one aspect of the invention, a method of performing a test on a formation intersected by a wellbore is provided. The method includes the steps of installing a test apparatus in the wellbore, flowing fluid from the formation into the apparatus and applying pressure to the apparatus, thereby forcing the formation fluid to flow back into the formation from which it originated.

The test apparatus includes a fluid barrier reciprocably displaceable within the apparatus. The barrier has first and second opposite sides. The barrier displaces in a first direction in the apparatus as the formation fluid flows into the apparatus.

When pressure is applied to the apparatus on the second side of the barrier, the barrier displaces in a second direction opposite to the first direction. The formation fluid is forced by the applied pressure to flow back into the formation from which it originated.

In another aspect of the invention, a system for performing a test on a formation intersected by a wellbore is provided. The system includes at least one packer interconnected as part of an apparatus positioned in the wellbore, a fluid barrier reciprocably displaceable within the apparatus when fluid is flowed between the apparatus and the formation, and a module interconnected to the packer, the module alternately permitting and preventing setting and unsetting of the packer in response to reciprocal displacements of the barrier.

In yet another aspect of the invention, a system for performing a test on a formation intersected by a wellbore is provided. The system includes a fluid barrier reciprocably displaceable within an apparatus into which fluid from the formation is flowed, the barrier displacing when the formation fluid is flowed between the apparatus and the formation, and a valve in the apparatus, the valve being operated in response to displacement of the barrier.

In still another aspect of the invention a system for performing a test on a formation intersected by a wellbore is provided. The system includes a formation testing apparatus including at least one waste chamber and at least two packers configured for straddling the formation when set in the wellbore, the waste chamber being opened after the packers are set in response to pressure in an annulus formed between the apparatus and the wellbore.

Where there are multiple formations intersected by the wellbore to be tested, there may be a corresponding number of waste chambers. A module of the apparatus opens one of the waste chambers in sequence prior to each of the formations being tested.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
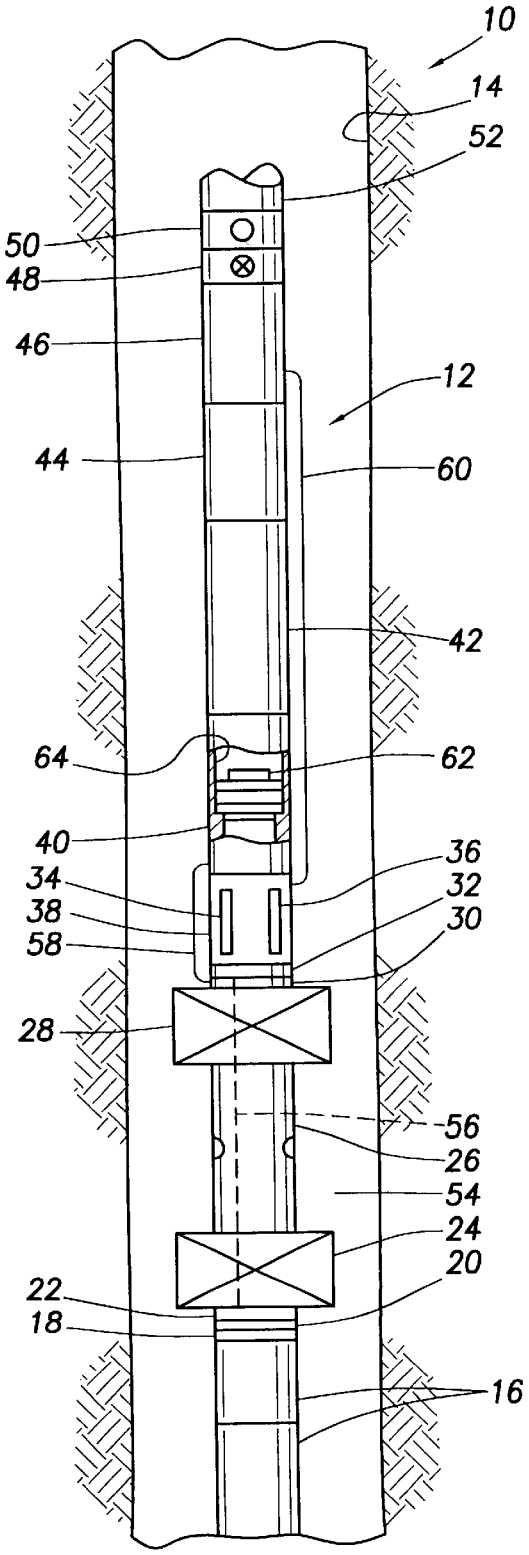
FIG. 1 is a schematic partially cross-sectional view of a method and system for open hole formation testing which embody principles of the present invention, wherein a test string is being run into a wellbore.

Representatively illustrated in FIG. 1 is a method 10 which embodies principles of the present invention. In the following description of the method 10 and other apparatus, systems and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, the method 10 utilizes a tubular test string 12 positioned in a wellbore 14 for performing a test on a formation intersected by the wellbore. The test string 12 includes multiple waste chambers 16, a waste chamber control module 18, an accumulator 20, a lower equalization sub 22, a lower packer 24, a ported sub 26, an upper packer 28, a packer inflation sub 30, an upper equalization sub 32, a sensor 34 and a sampler 36 mounted to a carrier 38, a combined no-go and packer inflation actuator 40, a fluid chamber 42, a combined no-go and valve 44, a communication module 46, a circulating valve 48, a fill valve 50, and tubing or pipe 52.

The waste chambers 16 are used to remove wellbore fluid from an annulus 54 between the string 12 and the wellbore 14 in the area between the packers 24, 28 in the beginning stages of a test, as will be described in more detail below. Multiple waste chambers 16 are shown in FIG. 1, since multiple formation tests may be performed on respective multiple formations using the string 12 on a single trip into the wellbore 14. One of the waste chambers 16 is opened for each of the formations tested, that is, each of the waste chambers is opened when a corresponding one of the formations is tested.

Of course, a single formation may be tested multiple times, in which case one or more waste chambers 16 may be opened for that formation's tests. In addition, it is to be clearly understood that use of the waste chambers 16 is optional, or only a single waste chamber may be used, in keeping with the principles of the present invention.

Opening of the waste chambers 16 is controlled by the control module 18. The control module 18 is actuated by pressure applied to the annulus 54. Thus, when it is desired to open one of the waste chambers 16, pressure, or a coded sequence of pressures, is applied to the annulus 54 above the upper packer 28. This annulus pressure causes the control module 18 to open the next waste chamber 16 in sequence.

For example, the control module 18 may include a ratchet mechanism, such as a J-slot mechanism, to select which waste chamber 16 is to be opened in response to the annulus pressure. Of course, if the waste chambers 16 are not used, the control module 18 would also not be used. Note that, instead of opening the waste chambers 16 sequentially, the control module 18 could alternatively open a single waste chamber repeatedly, that is, the waste chamber could be opened each time a formation is tested.

The accumulator 20 is used to store inflation pressure used to inflate the packers 24, 28. For example, the accumulator 20 may be of the type known to those skilled in the art as a nitrogen dome charge. The accumulator 20 is in fluid communication with the inflation fluid passages (not shown) for the packers 24, 28 so that, when pressure is applied to the passages to inflate the packers, the accumulator acts as a "cushion" to prevent overpressurization of the packer elements.

The upper and lower equalization subs 22, 32 are used to equalize pressure across the packers 24, 28. An internal equalization line 56 extends between the equalization subs 22, 32. Basically, the equalization subs 22, 32 prevent a pressure differential from occurring in the annulus 54 across the packers 24, 28 when they are set in the wellbore 14. Use of such equalization subs 22, 32 is well known to those skilled in the art.

The packers 24, 28 are preferably conventional inflatable packers of the type well known in the art. For example, they may be Hydroflate™packers available from Halliburton Energy Services. Of course, other types of packers may be used, in keeping with the principles of the present invention.

The ported sub 26 extends between the packers 24, 28 and provides a means for receiving fluid into the string 12. After the packers 24, 28 are set, one of the waste chambers 16 is opened and wellbore fluid in the annulus 54 between the packers enters the ported sub 26 and flows into the waste chamber. During a formation test, fluid from a formation isolated between the packers 24, 28 is drawn into the ported sub 26 and flows into the string 12 as described more fully below.

The packer inflation sub 30 receives pressurized inflation fluid from the no-go/actuator 40 via a line 58. The inflation sub 30 directs the inflation fluid to the packers 24, 28. The use of the inflation sub 30 is conventional and well known in the art.

The carrier 38 with the sensor 34 and sampler 36 is used to detect certain fluid properties and take one or more samples of fluid received in the string 12. Although only one sensor 34 and one sampler 36 are depicted, any number of sensors and samplers may be used. For example, pressure, temperature, flow, density, pH, or any other type of sensor may be used, and a separate sampler may be used for each formation tested. Such sensors and samplers are conventional and well known in the art.

The illustrated sensor 34 and sampler 36 are in communication with the communication module 46 via lines 60. In this manner, the communication module 46 is able to receive data from the sensor 34 and sampler 36. For example, pressure and temperature indications may be communicated from the sensor 34, and confirmation of receipt of a fluid sample may be communicated from the sampler 36, via the lines 60. In addition, the sampler 36 may be actuated in response to a signal received at the communication module 46.

The communication module 46 provides a means of retrieving the data communicated from the sensor 34 and sampler 36. Preferably, the communication module 46 provides a means of retrieving the data in real time. For example, the communication module 46 may be a telemetry device which communicates directly or indirectly with a remote location, such as the earth's surface. For instance, the communication module 46 could be an acoustic telemetry device which communicates with the earth's surface using pressure pulses transmitted via fluid in the wellbore 14 or transmitted via the tubing string 52, such as the ATS™ system available from Halliburton Energy Services.

As another example, the communication module 46 could be a wet connect device which permits a wireline-conveyed tool to retrieve the data from the module, either in real time or as stored data. As yet another example, the data could be communicated via one or more lines installed in the well with the string 12, such as lines embedded in a sidewall of the string or extending through an interior passage of the string.

If the string 12 is wireline-conveyed, instead of tubing-conveyed, into the well, then communication of the data may be via the wireline. Thus, any means of communicating the data may be utilized, without departing from the principles of the present invention.

A plug, pig, wiper or other type of fluid barrier 62 is reciprocally and sealingly received within a flow passage 64 formed within the string 12. The no-go/actuator 40 defines a lower limit of the plug's travel, and the no-go/valve 44 defines an upper limit of the plug's travel. As depicted in FIG. 1, the plug 62 is at the lower limit of its travel and is received within the no-go/actuator 40.

The no-go/actuator 40 is additionally used to provide inflation fluid pressure for inflating the packers 24, 28. When the plug 62 is received in the no-go/actuator 40 and pressure is applied to the string 12 above the plug, the plug is biased downwardly. This downwardly biasing force is used to discharge inflation fluid from the actuator portion of the no-go/actuator 40 via the line 58.

For example, the plug 62 may engage a piston of the no-go/actuator 40 when it is received therein. Pressure applied to the string 12 above the plug 62 would then displace the piston downward, forcing inflation fluid to flow from the no-go/actuator 40 to the packer inflation sub 30 via the line 58.

Note that, although the no-go/actuator 40 is depicted in FIG. 1 and described herein as a single tool in the string 12, the no-go portion could be separate from the actuator portion. In addition, other or alternate means of supplying inflation fluid pressure to the packers 24, 28 could be provided, without departing from the principles of the present invention.

The chamber 42 provides a substantial volume in which to receive fluid from a formation being tested. For example, the chamber 42 may have a capacity of approximately 20 barrels. Of course, other volumes may be used in keeping with the principles of the present invention.

Preferably, the chamber 42 is made up of multiple sections of flush joint tubing having a relatively smooth bore in which the plug 62 may be sealingly and reciprocally received. This provides a relatively inexpensive means of making up a substantial volume, while enabling the plug 62 to sealingly travel between the no-go/valve 44 and the no-go/actuator 40. Other types of chambers may be used, without departing from the principles of the present invention.

The no-go/valve 44 is used to define an upper limit to the travel of the plug 62 as described above, and to operate a valve portion thereof to selectively permit and prevent flow through the passage 64 above the plug. The valve portion of the no-go/valve 44 provides an additional form of isolation between the formation during a test and the tubing 52 extending to the earth's surface. That is, both the plug 62 and the valve portion of the no-go/valve 44 are barriers to fluid flow between the formation being tested and the earth's surface when the tubing string 52 extends to the earth's surface.

Some regulatory agencies require multiple forms of isolation during formation tests where the test string extends to the earth's surface. However, it is to be understood that the valve portion of the no-go/valve is not strictly necessary to the performance of a formation test using the string 12, and its use may not be required by regulatory agencies when, for example, other forms of isolation are used, the string is conveyed on wireline instead of on the tubing 52, etc.

Note that, although the no-go/valve 44 is depicted in FIG. 1 and described herein as a single tool in the string 12, the no-go portion could be separate from the valve portion. In addition, other or alternate means of isolation could be provided, without departing from the principles of the present invention.

When the plug 62 is received in the no-go/valve 44 and pressure above the plug is less than pressure in the passage 64 below the plug, the plug is biased upwardly. This upward biasing force on the plug 62 is used to close the valve. For example, if the valve is a ball valve, the biasing force may be used to rotate the ball of the valve in a manner well known to those skilled in the art. Of course, other types of valves may be used in keeping with the principles of the present invention.

When it is desired to open the valve of the no-go/valve 44, pressure is increased above the valve. A differential pressure across the valve, for example, across a ball of the valve, generates a downwardly biasing force. The valve opens in response to the downwardly biasing force, for example, by rotating a ball of the valve.

The circulating valve 48 is used to circulate fluid between the interior of the tubing string 52 and the annulus 54. For example, the circulating valve 48 may be opened after the formation testing operations are completed to allow fluid to drain out of the tubing string 52 as it is retrieved from the well, or the circulating valve may be opened to circulate fluids for purposes of well control, etc. The circulating valve 48 is conventional and its use is well known in the art.

The fill valve 50 is used to permit the tubing string 52 to fill with fluid as it is run into the well. The fill valve 50 may close automatically when a certain hydrostatic pressure is achieved, or the fill valve may be closed by application of pressure thereto after a desired depth has been reached. Various types of commercially available valves may be used for the fill valve 50, such as the AutoFill™ valve available from Halliburton Energy Services.

The tubing string 52 is used to convey the test string 12 into the well. The tubing string 52 could be made up of multiple lengths of tubing, or it could be coiled tubing. As discussed above other types of conveyance may be used in place of the tubing string 52. For example, a wireline could be used. In that case, the fill valve 50 and circulating valve 48 would not be used, since there would be no need for these tools. Thus, any form of conveyance may be used, without departing from the principles of the present invention.

In FIG. 1, the string 12 is depicted as it is being run into the wellbore 14. The packers 24, 28 are unset. The plug 62 is received in the no-go/actuator 40, but inflation pressure is not yet being supplied to the packer inflation sub 30. The plug 62 could actually be positioned anywhere between the no-go/actuator 40 and the no-go/valve 44 while the string 12 is run into the well.

The fill valve 50 is open, permitting the tubing 52 to fill with fluid. The circulating valve 48 is closed.

Figure 2:
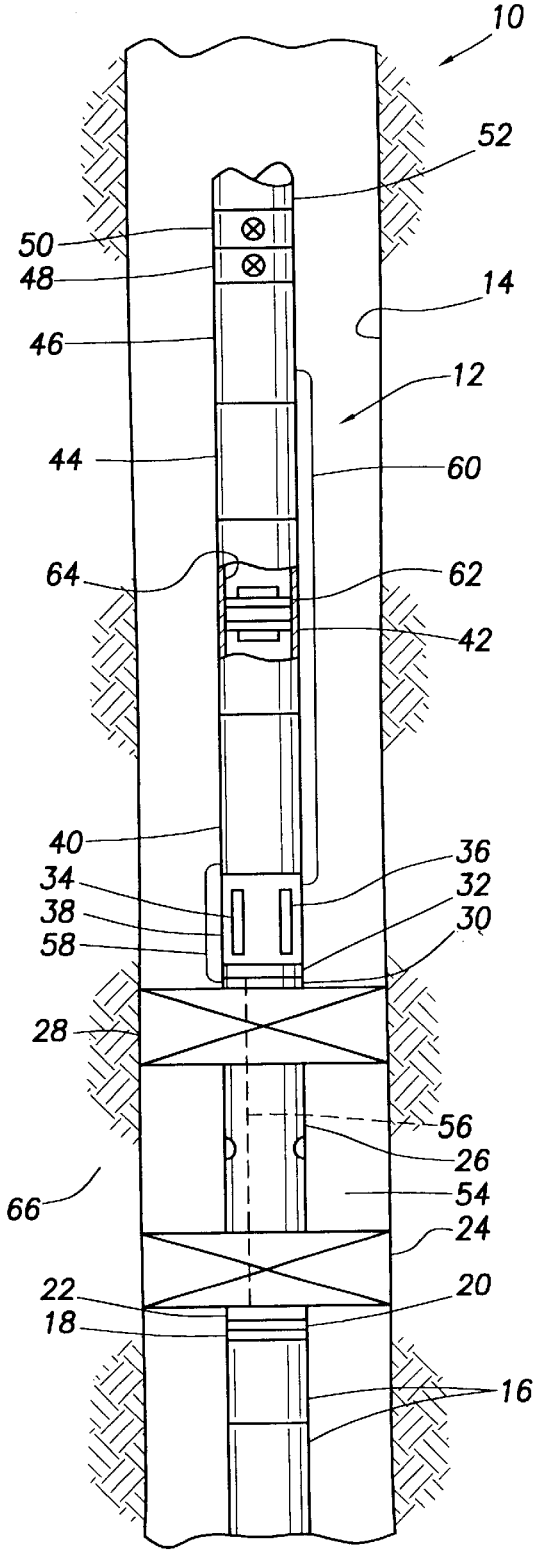
FIG. 2 is a schematic partially cross-sectional view of the system and method, wherein packers of the test string have been set in the wellbore.

Referring additionally now to FIG. 2, the test string 12 is positioned opposite a formation 66 to be tested. As used herein, the term "formation" is used to indicate a subterranean formation or portion of a formation, such as a zone.

The packers 24, 28 have been set in the wellbore 14 as described above. That is, with the plug 62 received in the no-go actuator 40 as depicted in FIG. 1, pressure is applied to the passage 64 above the plug to thereby cause inflation fluid to flow from the actuator portion of the no-go/actuator to the packer inflation sub 30. Once the packers 24, 28 have been set, the actuator is operated to close off flow of inflation fluid between the actuator and the packer inflation sub 30, for example, by closing a valve controlling flow through the line 58. This valve may be operated, for example, by a ratchet mechanism, such as a J-slot mechanism, in the actuator.

Note that the fill valve 50 should be closed prior to setting the packers 24, 28, to permit pressure to be applied to the tubing string 52. As described above, the fill valve 50 may be closed in any of a variety of ways. For example, the fill valve 50 may be configured to close when a certain hydrostatic pressure is reached, pressure may be applied to the wellbore 14, etc. In FIG. 2, the fill valve 50 is shown as being closed.

After the packers 24, 28 are set, the waste chamber control module 18 is operated to open one of the waste chambers 16. When opened, the waste chamber 16 draws fluid into the chamber from the annulus 54 between the packers 24, 28 through the ported sub 26. Of course, fluid from the interior of the string 12 below the plug 62 is also drawn into the open waste chamber 16.

The fluid drawn into the waste chamber 16 will principally be wellbore fluid, although some fluid from the formation 66 may also be drawn into the waste chamber at this time. The main objective of using the waste chamber 16 is to remove a substantial portion of the wellbore fluid prior to initiating the formation test, so that measurements and samples taken by the sensor 34 and sampler 36 are representative of the formation fluid rather than the wellbore fluid.

After use of the waste chamber 16, pressure above the plug 62 is decreased relative to pressure in the formation 66, so that the plug is displaced upwardly and fluid from the formation is drawn into the string 12 via the ported sub 26. This pressure differential across the plug 62 may be accomplished in any of a variety of manners. For example, a lighter density fluid may be circulated into the tubing string 52 using the circulating valve 48, gas, such as nitrogen, may be used to displace fluid from the tubing string 52, etc.

Note that, since flow of inflation fluid between the no-go/actuator 40 and the packer inflation sub 30 has been prevented at this point, the packers 24, 28 do not deflate when the plug 62 displaces upwardly in the passage 64. Instead, the packers 24, 28 remain inflated.

As the volume of formation fluid in the string 12 increases, the plug 62 displaces upwardly. Eventually, the plug 62 is received in the no-go/valve 44.

This drawing of fluid from the formation 66 into the string 12 is known as the drawdown phase of the formation test. The sensor 34 measures parameters, such as pressure and temperature, during this phase in order to facilitate determination of various characteristics of the formation 66. The communication module 46 preferably makes this sensor data available for analysis at a remote location while the test is being performed.

Figure 3:
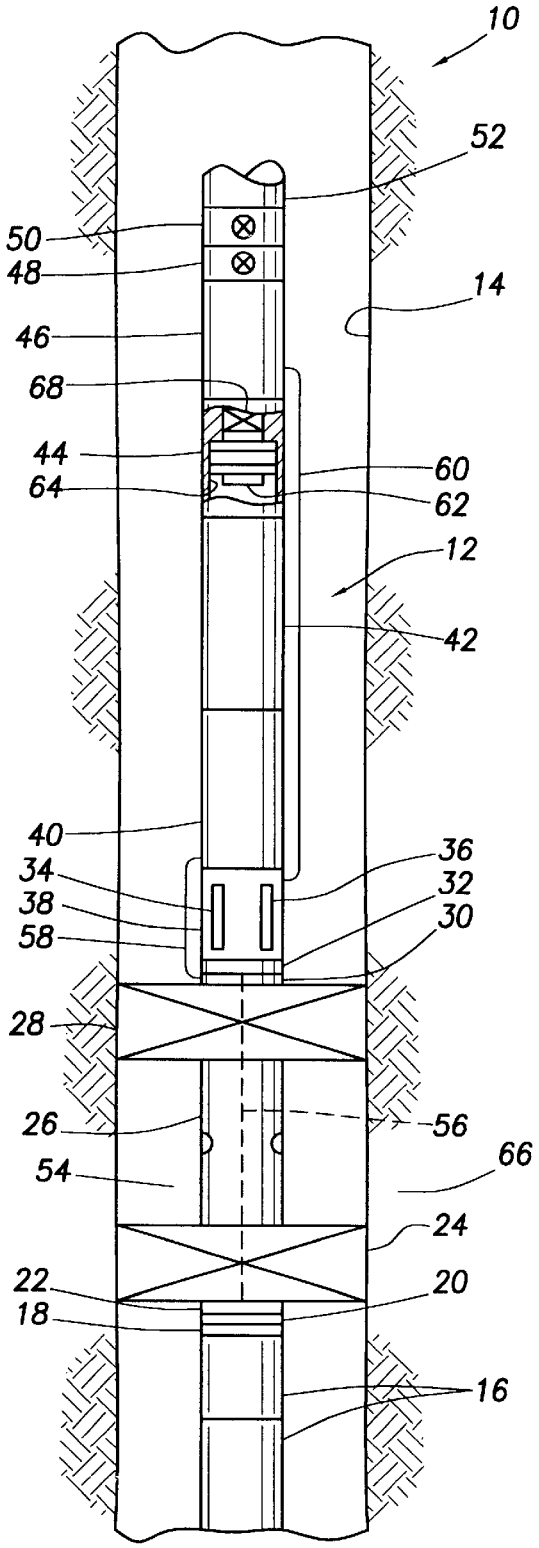
FIG. 3 is a schematic partially cross-sectional view of the system and method, wherein formation fluid has been drawn into the test string.

Referring additionally now to FIG. 3, the method 10 is representatively illustrated wherein the plug 62 has been received in the no-go/valve 44. The pressure differential across the plug 62 applies a biasing force to the no-go/valve 44, thereby closing the valve 68 thereof. As described above, the valve 68 provides additional isolation from the formation 66 in the tubing string 52.

Pressure in the flow passage 64 will continue to build until it substantially equals the pressure in the formation 66. This is known as the buildup portion of the formation test. Again, the sensor 34 detects various parameters used to characterize the formation and the properties of the fluid therein.

Once the buildup portion of the formation test is completed, the sampler 36 is actuated to obtain a sample of the formation fluid received into the string 12. One or more samples may be taken for each formation test. As described above, the sampler 36 may be actuated to obtain a sample in response to a signal received by the communication module 46.

Figure 4:
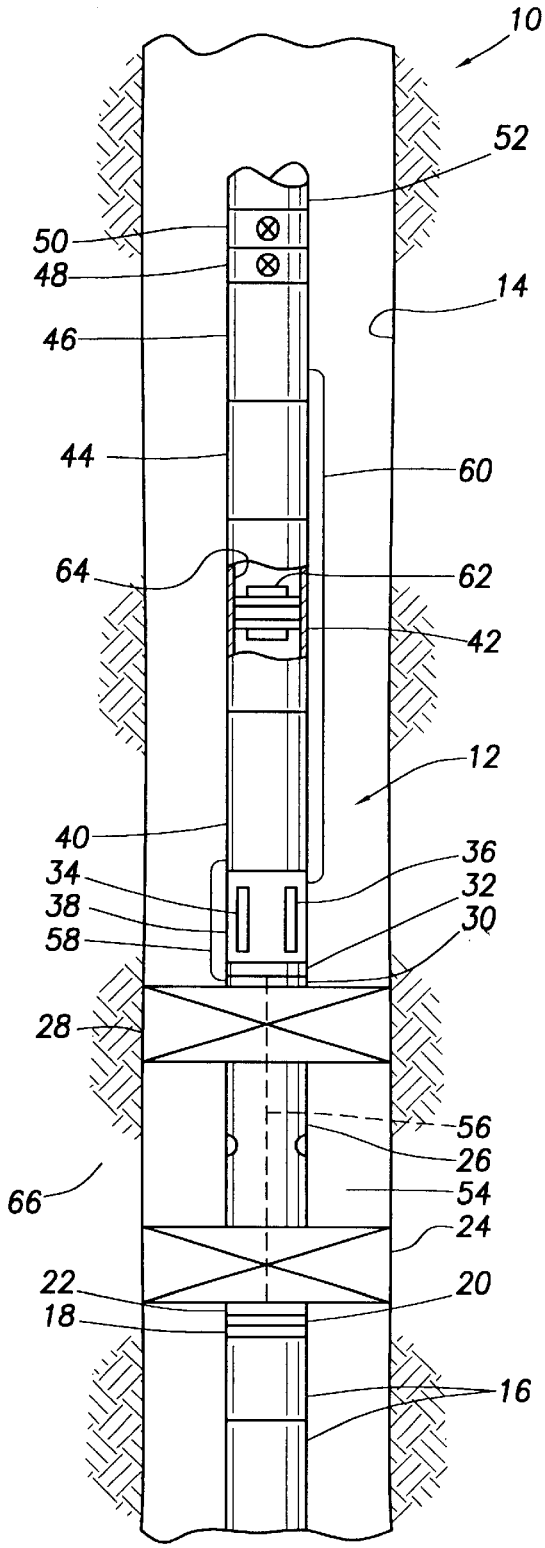
FIG. 4 is a schematic partially cross-sectional view of the system and method, wherein the formation fluid is being injected back into the formation from which it originated.

Referring additionally now to FIG. 4, the method 10 is representatively illustrated wherein the formation fluid received into the string 12 is being re-injected back into the formation 66 from which it originated. Pressure above the valve 68 of the no-go/valve 44 has been increased to apply a downwardly biasing force to the valve and cause it to open as described above. The increased pressure may now be applied through the open valve 68 to the plug 62.

A pressure differential from above to below the plug 62 causes the plug to displace downwardly in the passage 64. The plug 62 thus forces the formation fluid received in the string 12 downward and out of the ported sub 26. The formation fluid flows back into the formation 66 due to the pressure differential. Note that the pressure above the plug 62 and transmitted via the plug to the formation fluid in the string 12 must be greater than pressure in the formation 66 for the formation fluid to flow back into the formation.

Figure 5:
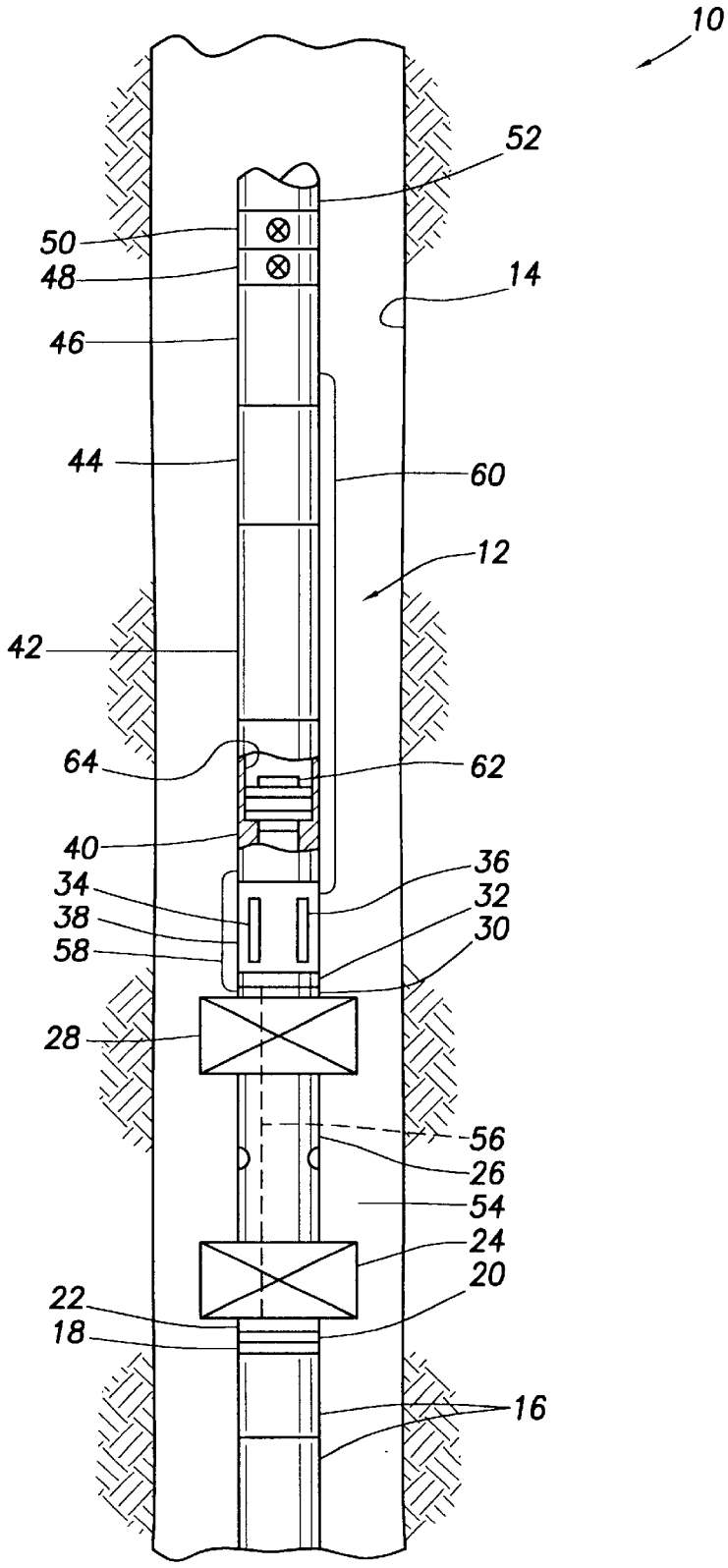
FIG. 5 is a schematic partially cross-sectional view of the system and method, wherein the formation fluid has been re-injected and the packers have been unset from the wellbore.

Referring additionally now to FIG. 5, the method 10 is representatively illustrated wherein the plug 62 has been displaced downwardly so that it is now received in the no-go/actuator 40. A pressure differential from above to below the plug 62 after it is received in the no-go/actuator 40 causes the actuator to permit flow of inflation fluid from the packer inflation sub 30 back into the actuator when pressure above the plug is decreased, thereby permitting the packers 24, 28 to deflate.

Thus, after the formation fluid has been re-injected into the formation 66, the plug 62 has engaged the no-go/actuator 40 and the actuator has been operated to permit flow of inflation fluid from the packer inflation sub 30 back into the actuator, pressure above the plug is decreased to deflate the packers 24, 28 by flowing inflation fluid from the packer inflation sub to the actuator.

The packers 24, 28 are now unset, and the string 12 is ready to be repositioned in the well to perform another formation test, or is ready to be retrieved from the well. Note that the formation test described above did not result in any formation fluid being flowed to the earth's surface. In addition, the formation test was performed very simply and conveniently by alternately increasing and decreasing pressure above the plug 62, for example, by applying and releasing pressure on the tubing string 52.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, although the method 10 has been described above as being performed using straddle packers 24, 28, a formation maybe isolated for testing using only a single packer. As another example, although the method 10 has been described above as being performed in an open hole or uncased wellbore 14, the principles of the present invention are applicable in cased wellbores. Accordingly, the foregoing detailed description is to be clearly understood as being given by way of illustration and example only, the spirit and scope of the present invention being limited solely by the appended claims and their equivalents.

What is claimed is:

1. A method of performing a test on a formation intersected by a wellbore, the method comprising the steps of:

installing a test apparatus in the wellbore, the test apparatus including a fluid barrier reciprocably displaceable within the apparatus, the barrier having first and second opposite sides;

flowing fluid from the formation into the apparatus on the first side of the barrier, the barrier displacing in a first direction in the apparatus as the formation fluid flows into the apparatus; and applying pressure to the apparatus on the second side of the barrier, thereby displacing the barrier in a second direction opposite to the first direction in the apparatus and forcing the formation fluid to flow back into the formation from which the fluid originated, the barrier preventing flow therethrough when formation fluid is flowed into the test apparatus.

2. The method according to claim 1, wherein in the installing step, the apparatus includes a tubular string extending to a remote location, and wherein the barrier is axially reciprocably received in the string.

3. The method according to claim 2, wherein in the applying step, pressure is applied to the string at the earth's surface to displace the barrier downwardly.

4. The method according to claim 1, wherein in the installing step, the barrier is a plug sealingly received in a bore of the apparatus.

5. The method according to claim 1, further comprising the step of closing a valve of the apparatus in response to the barrier displacing in the first direction in the flowing step.

6. The method according to claim 5, further comprising the step of opening the valve in response to the pressure applying step.

7. The method according to claim 5, wherein in the closing step, the valve prevents flow through a flow passage in which the barrier is reciprocably received.

8. The method according to claim 7, wherein in the installing step, the apparatus includes a tubular string extending to a remote location, and the flow passage is in fluid communication with an interior of the tubular string.

9. The method according to claim 8, wherein in the applying step, pressure is applied to the interior of the tubular string, the valve opens in response to the pressure, and the pressure is communicated through the open valve from the tubular string interior to the barrier second side.

10. A method of performing a test on a formation intersected by a wellbore, the method comprising the steps of:

installing a test apparatus in the wellbore, the test apparatus including a fluid barrier reciprocably displaceable within the apparatus, the barrier having first and second opposite sides;

flowing fluid from the formation into the apparatus on the first side of the barrier, the barrier displacing in a first direction in the apparatus as the formation fluid flows into the apparatus;

applying pressure to the apparatus on the second side of the barrier, thereby displacing the barrier in a second direction opposite to the first direction in the apparatus and forcing the formation fluid to flow back into the formation from which the fluid originated; and setting at least one packer of the apparatus in response to displacement of the barrier in the second direction prior to the flowing step.

11. The method according to claim 10, wherein the setting step is performed further in response to applying pressure to the apparatus on the second side of the barrier, which pressure applying step causes the barrier to displace in the second direction.

12. The method according to claim 11, wherein in the installing step, the apparatus includes a tubular string extending to a remote location, and wherein in the setting step, pressure is applied to the tubular string at the remote location to displace the barrier in the second direction.

13. The method according to claim 1, further comprising the step of opening a waste chamber of the apparatus prior to flowing the formation fluid into the apparatus, opening of the waste chamber permitting wellbore fluid to flow into the waste chamber.

14. The method according to claim 13, wherein the waste chamber opening step is performed in response to pressure applied to an annulus formed between the apparatus and the wellbore.

15. The method according to claim 13, further comprising the step of setting at least one packer of the apparatus in the wellbore prior to the flowing step, and wherein the waste chamber opening step is performed after the setting step.

16. The method according to claim 13, wherein there are multiple waste chambers, and wherein the waste chamber opening step further comprises sequentially and selectively opening each of the waste chambers.

17. A method of performing a test on a formation intersected by a wellbore, the method comprising the steps of:

installing a test apparatus in the wellbore, the test apparatus including a fluid barrier reciprocably displaceable within the apparatus, the barrier having first and second opposite sides;

flowing fluid from the formation into the apparatus on the first side of the barrier, the barrier displacing in a first direction in the apparatus as the formation fluid flows into the apparatus;

applying pressure to the apparatus on the second side of the barrier, thereby displacing the barrier in a second direction opposite to the first direction in the apparatus and forcing the formation fluid to flow back into the formation from which the fluid originated; and opening a waste chamber of the apparatus prior to flowing the formation fluid into the apparatus, opening of the waste chamber permitting wellbore fluid to flow into the waste chamber, there being multiple waste chambers, and wherein the waste chamber opening step further comprises sequentially and selectively opening each of the waste chambers, there being multiple formations intersected by the wellbore, wherein the formation fluid flowing and pressure applying steps are performed for each of multiple selected ones of the formations, and wherein the waste chamber opening step is performed for each of the selected formations, each of the waste chambers being opened for a corresponding one of the selected formations prior to the respective flowing step.

18. The method according to claim 1, wherein there are multiple formations intersected by the wellbore, wherein the formation fluid flowing and pressure applying steps are performed for each of multiple selected ones of the formations.

19. A system for performing a test on a formation intersected by a wellbore, the system comprising:

a fluid barrier reciprocably displaceable within an apparatus into which fluid from the formation is flowed, the barrier reciprocably displacing when the formation fluid is flowed between the apparatus and the formation; and a valve in the apparatus, the valve being operated in response to displacement of the barrier, the fluid barrier preventing flow therethrough when formation fluid is flowed into the apparatus.

20. The system according to claim 19, wherein the valve operates in response to displacement of the barrier in a first direction, and wherein the barrier displaces in the first direction when formation fluid is flowed into the apparatus.

21. The system according to claim 20, wherein the valve closes in response to displacement of the barrier in the first direction.

22. The system according to claim 20, wherein the valve operates when the barrier displaces in a second direction opposite to the first direction, and wherein the barrier displaces in the second direction when formation fluid is flowed out of the apparatus.

23. The system according to claim 19, wherein the apparatus includes a tubular string positioned in the wellbore, the tubular string having an interior in fluid communication with a flow passage extending through the valve.

24. A system for performing a test on a formation intersected by a wellbore, the system comprising:

a fluid barrier reciprocably displaceable within an apparatus into which fluid from the formation is flowed, the barrier displacing when the formation fluid is flowed between the apparatus and the formation; and a valve in the apparatus, the valve being operated in response to displacement of the barrier, the apparatus including a tubular string positioned in the wellbore, and the tubular string having an interior in fluid communication with a flow passage extending through the valve, and the barrier displacing in the first direction, thereby closing the valve and preventing flow through the flow passage, when pressure in the tubular string interior is less than pressure in the formation, and the barrier displacing in the second direction and the valve opening, thereby permitting flow through the flow passage, when pressure in the tubular string interior is greater than pressure in the formation.

25. A system for performing a test on a formation intersected by a wellbore, the system comprising:

at least one packer interconnected as part of a drill string apparatus positioned in the wellbore;

a fluid barrier reciprocably displaceable within the apparatus when fluid is flowed between the apparatus and the formation; and a control module interconnected to the packer, the module alternately permitting and preventing setting and unsetting of the packer in response to reciprocal displacements of the barrier.

26. The system according to claim 25, wherein the module responds to reciprocal displacements of the barrier in the following sequence:

displacement of the barrier in a first direction causes the module to permit setting of the packer;

displacement of the barrier in a second direction opposite to the first direction causes the module to prevent unsetting of the packer;

displacement of the barrier in the first direction causes the module to permit unsetting of the packer when the barrier next displaces in the second direction; and displacement of the barrier in the second direction causes the module to permit unsetting of the packer.

27. The system according to claim 26, wherein the module is configured to permit repetition of the sequence.

* * * * *